US009816402B2

(12) United States Patent
Kauffman et al.

(10) Patent No.: US 9,816,402 B2
(45) Date of Patent: Nov. 14, 2017

(54) HEAT RECOVERY SYSTEM SERIES ARRANGEMENTS

(75) Inventors: Justin P. Kauffman, Mount Wolf, PA (US); Andrew M. Welch, Mount Wolf, PA (US); Gregory R. Dawson, York, PA (US); Eric N. Minor, New Park, PA (US)

(73) Assignee: Johnson Controls Technology Company, Holland, MI (US)

( * ) Notice: Subject to any disclaimer, the term of this patent is extended or adjusted under 35 U.S.C. 154(b) by 556 days.

(21) Appl. No.: 13/358,070

(22) Filed: Jan. 25, 2012

(65) Prior Publication Data

US 2012/0192563 A1 Aug. 2, 2012

Related U.S. Application Data

(60) Provisional application No. 61/437,372, filed on Jan. 28, 2011.

(51) Int. Cl.

| | |
|---|---|
| ***F01B 17/02*** | (2006.01) |
| ***F01K 23/04*** | (2006.01) |
| ***F01K 23/06*** | (2006.01) |
| ***F01K 25/06*** | (2006.01) |
| ***F01K 25/08*** | (2006.01) |
| ***F01K 25/10*** | (2006.01) |
| ***F01K 9/00*** | (2006.01) |
| ***F01K 17/02*** | (2006.01) |

(52) U.S. Cl.

CPC ..... *F01K 25/10* (2013.01); *F01B 17/02* (2013.01); *F01K 9/003* (2013.01); *F01K 17/02* (2013.01); *F01K 23/04* (2013.01); *F01K 23/065* (2013.01); *F01K 25/06* (2013.01); *F01K 25/08* (2013.01); *F01K 25/103* (2013.01)

(58) Field of Classification Search

CPC ..... F01K 23/04; F01K 23/065; F01K 25/06; F01K 25/08; F01K 25/10; F01K 25/103; F01K 9/003; F01B 17/02

USPC ..... 60/671, 645, 651, 670, 676, 641.1, 648, 60/655

See application file for complete search history.

(56) References Cited

U.S. PATENT DOCUMENTS

| | | | | |
|---|---|---|---|---|
| 3,234,738 A * | 2/1966 | Cook | ..... | 60/651 |
| 3,303,646 A * | 2/1967 | Southam | ..... | 60/655 |
| 3,795,103 A * | 3/1974 | Anderson | ..... | F01K 3/185 60/651 |

(Continued)

FOREIGN PATENT DOCUMENTS

WO WO 2010016825 A2 * 2/2010 ..... F01K 9/003

*Primary Examiner* — Mark Laurenzi
*Assistant Examiner* — Wesley Harris
(74) *Attorney, Agent, or Firm* — Fletcher Yoder, P.C.

(57) ABSTRACT

The present disclosure is directed to heat recovery systems that employ two or more organic Rankine cycle (ORC) units disposed in series. According to certain embodiments, each ORC unit includes an evaporator that heats an organic working fluid, a turbine generator set that expands the working fluid to generate electricity, a condenser that cools the working fluid, and a pump that returns the working fluid to the evaporator. The heating fluid is directed through each evaporator to heat the working fluid circulating within each ORC unit, and the cooling fluid is directed through each condenser to cool the working fluid circulating within each ORC unit. The heating fluid and the cooling fluid flow through the ORC units in series in the same or opposite directions.

12 Claims, 4 Drawing Sheets

(56) References Cited

U.S. PATENT DOCUMENTS

| | | | | |
|---|---|---|---|---|
| 4,400,947 | A * | 8/1983 | Ruhemann | 60/648 |
| 4,444,015 | A * | 4/1984 | Matsumoto et al. | 60/648 |
| 5,038,567 | A * | 8/1991 | Mortiz | F03G 7/04 60/671 |
| 6,892,522 | B2 | 5/2005 | Brasz et al. | |
| 6,962,056 | B2 | 11/2005 | Brasz et al. | |
| 8,474,262 | B2 * | 7/2013 | Regelman et al. | 60/651 |
| 2008/0168772 | A1 * | 7/2008 | Radcliff et al. | 60/651 |
| 2009/0178790 | A1 | 7/2009 | Schreiber et al. | |
| 2010/0242533 | A1 | 9/2010 | De Larminat et al. | |
| 2010/0276130 | A1 | 11/2010 | de Larminat et al. | |
| 2010/0319395 | A1 | 12/2010 | de Larminat et al. | |
| 2010/0326108 | A1 | 12/2010 | Schreiber et al. | |
| 2011/0088399 | A1 * | 4/2011 | Briesch | F01K 23/10 60/670 |
| 2011/0173978 | A1 * | 7/2011 | Rekret | F03G 7/05 60/641.7 |
| 2011/0173979 | A1 * | 7/2011 | Krull | F03G 7/05 60/641.7 |
| 2012/0047889 | A1 * | 3/2012 | Ulas Acikgoz et al. | 60/649 |
| 2012/0313371 | A1 * | 12/2012 | Gaia et al. | 290/2 |
| 2013/0025278 | A1 * | 1/2013 | Batscha | 60/641.2 |
| 2013/0104546 | A1 * | 5/2013 | Goswami et al. | 60/641.8 |

* cited by examiner

HEAT RECOVERY SYSTEM SERIES ARRANGEMENTS

CROSS REFERENCE TO RELATED APPLICATIONS

This application claims priority from and the benefit of U.S. Provisional Application Ser. No. 61/437,372, entitled "HEAT RECOVERY SYSTEM SERIES ARRANGEMENTS", filed Jan. 28, 2011, which is hereby incorporated by reference.

STATEMENT REGARDING FEDERALLY SPONSORED RESEARCH & DEVELOPMENT

This invention was made with Government support under contract number DE-EE0002858 awarded by the U.S. Department of Energy (DOE). The Government has certain rights in the invention.

BACKGROUND

The invention relates generally to heat recovery systems, and more specifically, to heat recovery systems that employ two or more organic Rankine cycle (ORC) units disposed in series.

Heat recovery systems are frequently employed to recover low-grade heat, such as heat with a temperature below approximately 500 to 1000° C., from industrial and commercial processes and operations. For example, heat recovery systems may be employed to recover geothermal energy, heat from hot exhaust gases produced by gas turbines or by reciprocating engines, heat from cooling water after it has cooled a process, or heat from flue gases used in industrial processes, among others. Heat recovery systems that implement an organic Rankine cycle by circulating an organic working fluid may be particularly efficient at recovering low-grade heat due to the relatively low phase change enthalpies of organic working fluids.

A typical ORC unit circulates an organic working fluid through a closed loop to convert heat into work. The working fluid is heated in an evaporator where the working fluid is evaporated to produce a vapor that is expanded across a turbine to turn the turbine shaft. The rotation of the turbine shaft drives a load, such as a generator, which produces electrical power. The expanded working fluid is then directed through a condenser where the vapor is condensed into a liquid. The liquid working fluid is then pressurized by a pump that returns the working fluid to the evaporator. Due to turbine load restrictions, design modularity desires, or other constraints, it may be desirable to employ multiple ORC units within a process to generate a desired amount of turbine output power.

DRAWINGS

DETAILED DESCRIPTION

The present disclosure is directed to heat recovery systems that employ two or more ORC units disposed in series with respect to the heating fluid and/or the cooling fluid. By disposing the ORC units in series where the heating fluid and/or the cooling flows first through one ORC unit and then through a second ORC unit, efficiency increases can be achieved when compared to ORC units that are disposed in parallel where the heating fluid and/or the cooling fluid is split into two portions with one portion directed to each unit. According to certain embodiments, the ORC units can be disposed in a unidirectional series arrangement where the heating fluid and the cooling fluid are directed through the ORC units in the same direction. For example, in a unidirectional series arrangement, the heating fluid and the cooling fluid both enter the system through the first unit and then flow through the second unit.

Further, in certain embodiments, the ORC units can be disposed in a series counterflow arrangement where the heating fluid and the cooling fluid flow through the ORC units in opposite directions. For example, in a series counterflow arrangement, the heating fluid enters the system through the first unit and then flows through the second unit, while the cooling fluid enters the system through the second unit and then flows through the first unit. The use of a series counterflow arrangement may provide similar pressure heads on each of the ORC units, which, in turn, can allow the same design configuration to be employed for each of the units.

Figure 1:
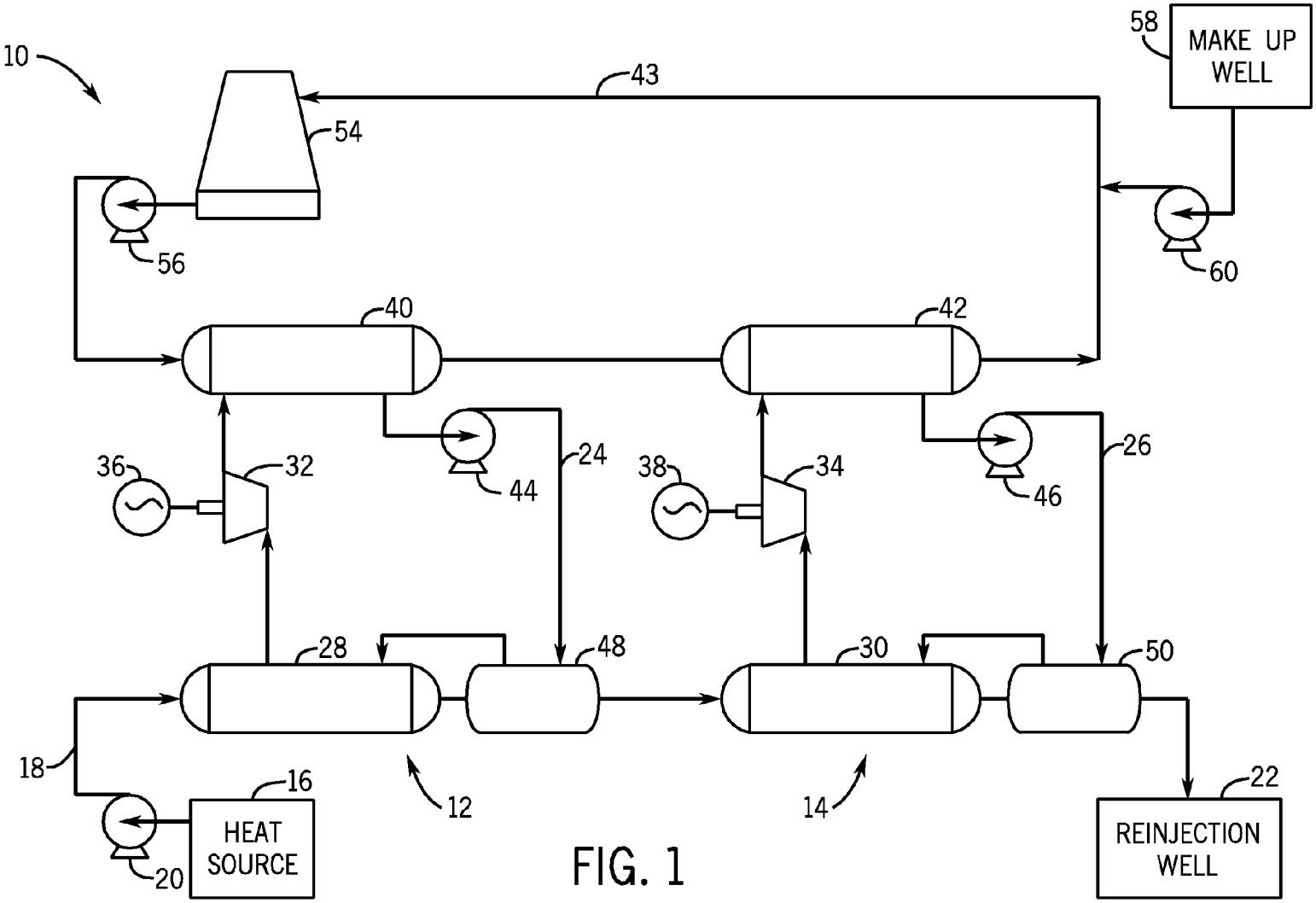
FIG. 1 is schematic flow diagram of an embodiment of a heat recovery system that employs multiple ORC units arranged in series.

FIG. 1 depicts an embodiment of a heat recovery system 10 that employs two ORC units 12 and 14 disposed in a unidirectional series arrangement. Each ORC unit 12 and 14 circulates an organic working fluid within a closed loop to recover heat from a heat source 16. In particular, a heating fluid circuit 18 circulates a heating fluid from heat source 16 through ORC units 12 and 14. Each ORC unit 12 and 14 is disposed in series with respect to circuit 18. In particular, circuit 18 directs the heating fluid first through ORC unit 12 and then through ORC unit 14 via a pump 20. Heat source 16 may be any system or process that produces heat, such as, for example, geothermal water from a production well, exhaust gas from a gas turbine, a land fill flare, or waste heat from an industrial process, among others. The heating fluid may be any fluid capable of absorbing heat, such as water, brine, or refrigerant, among others.

In certain embodiments, circuit 18 may directly circulate fluid from heat source 16. For example, circuit 18 may circulate a heated cooling fluid from a process that has been cooled. However, in other embodiments, one or more heat exchangers may be used to transfer heat from the process to the heating fluid that is circulated through circuit 18. For example, one or more heat exchangers may be employed to transfer heat from exhaust gas to the heating fluid that circulates within circuit 18. In another example, one or more heat exchangers may be employed to transfer heat from a process fluid to the heating fluid circulating within circuit 18.

As the heating fluid flows through ORC units 12 and 14, the heating fluid transfers heat to ORC units 12 and 14 and is then directed to a reinjection well 22. For example, according to certain embodiments, reinjection well 22 may be part of an oil production facility or a geothermal system. However, in other embodiments, reinjection well 22 may be replaced by another type of reservoir. For example, the fluid exiting ORC units 12 and 14 may be directed to a treatment system, a sewer, or a retaining pond, among others. Further, in certain embodiments, the heating fluid that exits ORC units 12 and 14 may be returned to a process where the fluid may be heated again.

Each ORC unit 12 and 14 includes a working fluid loop 24 and 26, respectively, that circulates an organic working fluid to recover heat from heat source 16. According to certain embodiments, the same type of organic working fluid may be circulated within each working fluid loop 24 and 26. However, in other embodiments, each working fluid loop 24 and 26 may circulate a different type of organic working fluid. The organic working fluid may be an organic, high molecular mass, fluid that has a higher vapor pressure and lower critical temperature than water. For example, the organic working fluid may be a single component refrigerant, such as HFC-245fa. In another example, the organic working fluid may be a multiple component fluid that behaves as a near azeotropic fluid with minimal glide, meaning that the multiple component fluid boils at a fairly constant temperature and condenses at a fairly constant temperature. Employing a single component fluid or near azeotropic multiple component fluid may promote efficiency in heat transfer within the heat exchangers of ORC units 12 and 14. However, in other embodiments, any suitable organic working fluid, such as a hydrocarbon fluid or refrigerant, may be employed.

Within each ORC unit 12 and 14, the working fluid loop 24 or 26 circulates the organic working fluid through an evaporator 28 or 30, respectively. According to certain embodiments, evaporators 28 and 30 may be shell and tube heat exchangers. Within evaporators 28 and 30, the working fluid absorbs heat from the heating fluid flowing through circuit 18. As the working fluid absorbs heat, all, or a substantial portion of the working fluid may change from a liquid phase to a vapor phase. The heated working fluid may then flow to a turbine 32 or 34 of ORC unit 12 or 14. Each turbine 32 and 34 is connected to a load, such as a generator 36 and 38, respectively. The vapor phase working fluid is expanded across each turbine 32 and 34, which causes a shaft of the turbine to rotate and drive the respective generator 36 or 38. According to certain embodiments, generators 36 and 38 produce electricity from the expansion of the heated working fluid.

From the turbine 32 or 34, the working fluid, which has been reduced in pressure, flows to a condenser 40 or 42, respectively. According to certain embodiments, condensers 40 and 42 may be shell and tube heat exchangers. As the working fluid flows through condensers 40 and 42, the working fluid transfers heat to a cooling fluid circulating within a cooling circuit 43. Accordingly, the cooling fluid absorbs heat from the working fluid, thereby causing the working fluid to condense. From condenser 40 or 42, the working fluid flows through a pump 44 or 46, which pressurizes the working fluid and directs the working fluid to a preheater 48 or 50.

Each preheater 48 and 50 heats the working fluid to a temperature slightly below the boiling point of the working fluid. According to certain embodiments, preheaters 48 and 50 may be shell and tube heat exchangers. As shown in FIG. 1, preheaters 48 and 50 are independent from evaporators 28 and 30. However, in other embodiments, preheaters 48 and 50 may each be an integral part of their respective evaporator 28 or 30. For example, in certain embodiments, preheater 48 or 50 may be included within evaporator 28 or 30 as one or more sections of tubes within a shell and tube heat exchanger. From preheaters 48 and 50, the working fluid returns to evaporators 28 and 30 where the process may begin again.

As discussed above, each condenser 40 and 42 is cooled by the cooling fluid flowing through cooling fluid circuit 43. As the cooling fluid flows through condensers 40 and 42, the cooling fluid absorbs heat from the organic working fluid. The cooling fluid circuit 43 then directs the heated cooling fluid through a heat rejection device, such as a cooling tower 54 that rejects heat from the cooling fluid to the environment. A pump 56 circulates the cooled cooling fluid within cooling circuit 43 and directs the cooling fluid from cooling tower 54 to condensers 40 and 42.

Cooling fluid circuit 43 also may receive make-up cooling fluid from a make-up well 58. For example, a pump 60 may circulate make-up cooling fluid from make-up well 58 to cooling circuit 43 when additional cooling fluid is desired. For example, in embodiments where cooling tower 54 is an open loop cooling tower, some of the cooling fluid may be lost by evaporation into the ambient air. In these embodiments, additional cooling fluid may be provided to cooling circuit 43 to replace the lost cooling fluid. Further, the cooling fluid may absorb contaminants, such as particulates, from the ambient air that may be removed in the form of blowdown. Make-up well 58 may be used to provide additional cooling fluid to replace the cooling fluid that was removed as blowdown.

In other embodiments, cooling tower 54 may be replaced by any suitable heat rejection device. For example, in other embodiments, one or both condensers 40 and 42 may be replaced by an air-cooled condenser that transfers heat from the working fluid to environmental air that is drawn through the air-cooled condenser. In these embodiments, cooling circuit 43 may be omitted. In another example, cooling circuit 43 may circulate cool water from a sea or lake. Further, in other embodiments, additional equipment, such as valves, temperature and/or pressure sensors or transducers, receivers, and the like may be included in heat recovery system 10. For example, in certain embodiments, one or more recuperators and/or super-heaters may be included within working fluid loops 24 and/or 26. Moreover, in certain embodiments, the location of the preheaters may vary. For example, in certain embodiments, both preheaters 48 and 50 may be disposed downstream of evaporator 30. Further, in certain embodiments, three or more ORC units may be disposed in a unidirectional series arrangement.

As shown in FIG. 1, the ORC units 12 and 14 are disposed in a unidirectional series arrangement. In particular, all of the heated fluid within circuit 18 that is heated by heat source 16 flows first through ORC unit 12 and then through ORC unit 14. Further, all of the cooling fluid that is circulated within circuit 43 flows first through ORC unit 12 and then through ORC unit 14. In other words, both the heating fluid and the cooling fluid flow through the ORC units 12 and 14 in series in the same direction.

Figure 2:
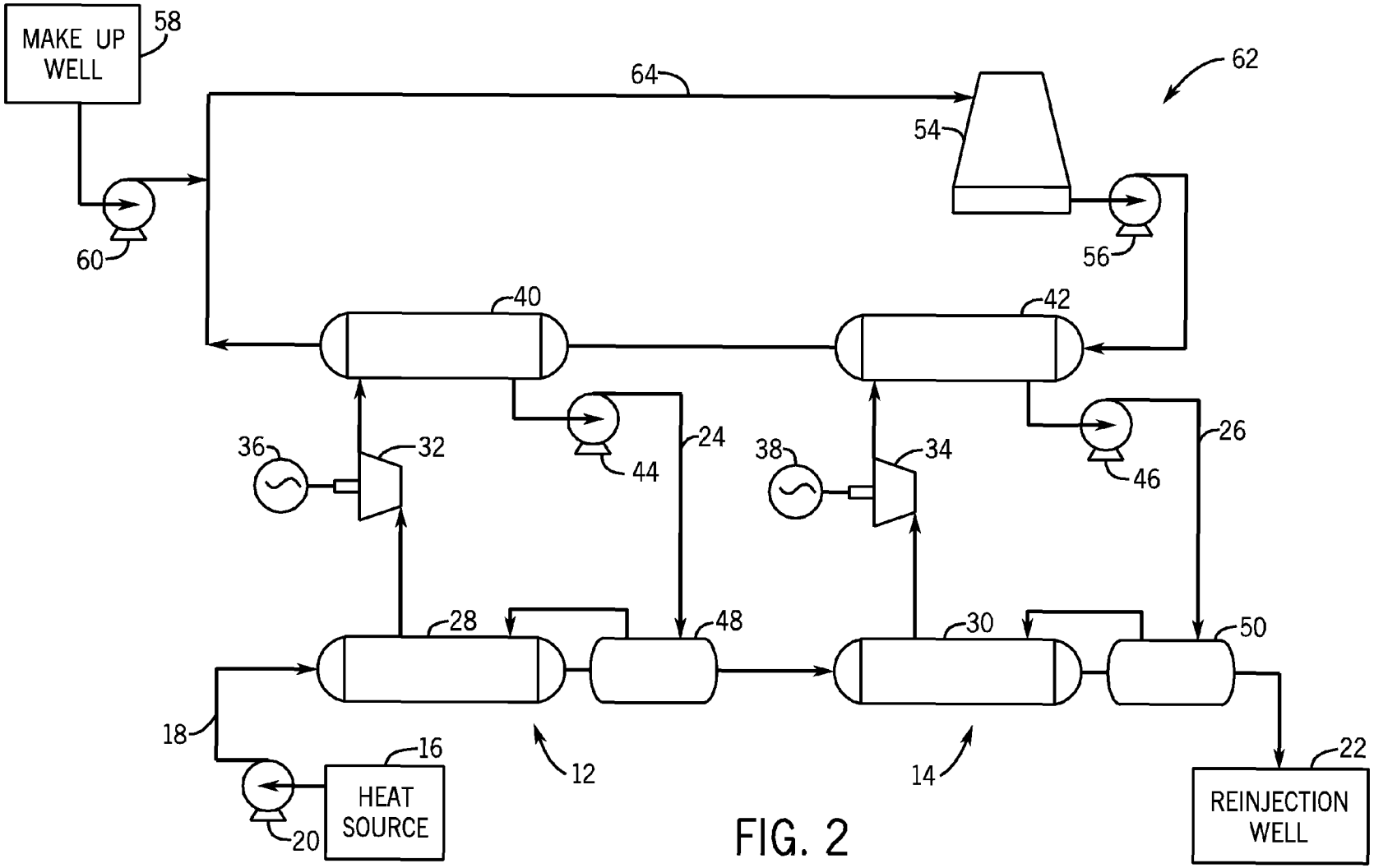
FIG. 2 is schematic flow diagram of another embodiment of a heat recovery system that employs multiple ORC units arranged in series.

FIG. 2 depicts another embodiment of a heat recovery system 62. Heat recovery system 62 is generally similarly to the heat recovery system 10 show in FIG. 1. However, rather than being disposed in a unidirectional series arrangement as shown in FIG. 1, ORC units 12 and 14 are disposed in a series counterflow arrangement. As shown in FIG. 2, in the series counterflow arrangement, the cooling fluid and the heating fluid are circulated through the ORC units 12 and 14 in opposite directions. For example, a cooling fluid circuit 64 circulates the cooling fluid first through condenser 42 of ORC unit 14 and then through condenser 40 of ORC unit 12. The heating fluid circuit 18 circulates the heating fluid through the ORC units 12 and 14 in the opposite direction. In particular, heating fluid circuit 18 circulates the heating fluid first through evaporator 28 of ORC unit 12 and then through evaporator 30 or ORC unit 14.

As may be appreciated, in other embodiments, cooling tower 54 may be replaced by any suitable heat rejection device, such as air-cooled condenser. Further, in certain embodiments, cooling circuit 64 may circulate cool water from a sea or lake. Moreover, additional equipment, such as valves, temperature and/or pressure sensors or transducers, receivers, and the like may be included in heat recovery system 62. For example, in certain embodiments, one or more recuperators and/or super-heaters may be included within working fluid loops 24 and/or 26. Moreover, in certain embodiments, the location of the preheaters may vary. For example, in certain embodiments, both preheaters 48 and 50 may be disposed downstream of evaporator 30. Further, in certain embodiments, three or more ORC units may be disposed in a series counterflow arrangement.

Figure 3:
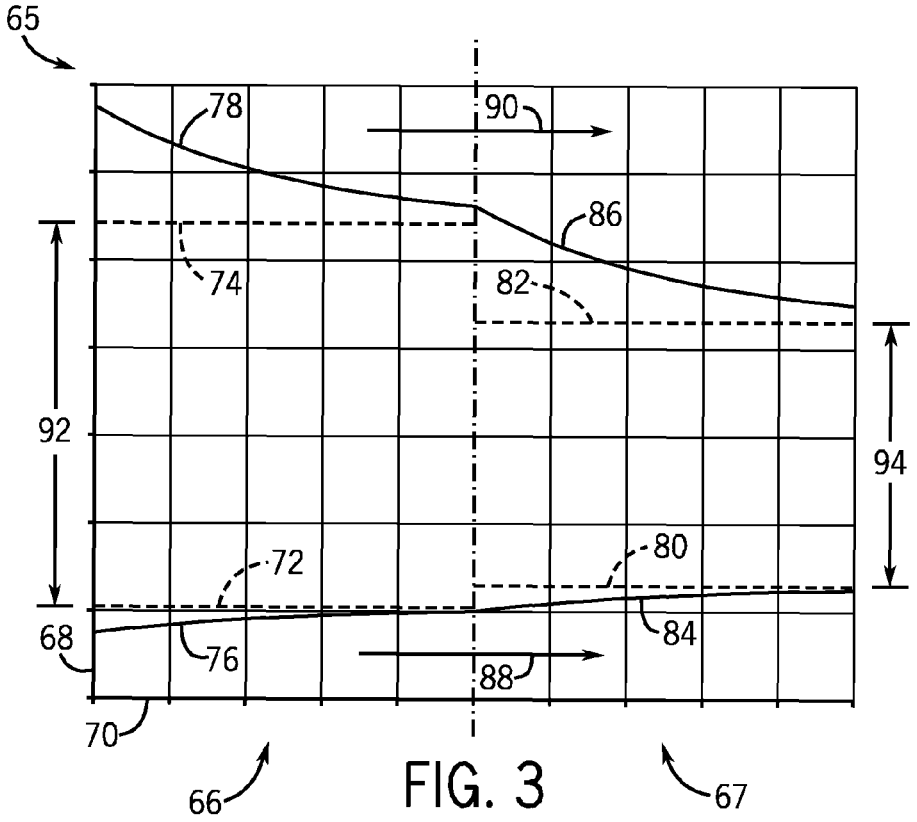
FIG. 3 is a chart depicting temperatures of the organic working fluid, the cooling fluid, and the heating fluid, as the fluids flow through the ORC units of FIG. 1.
Figure 4:
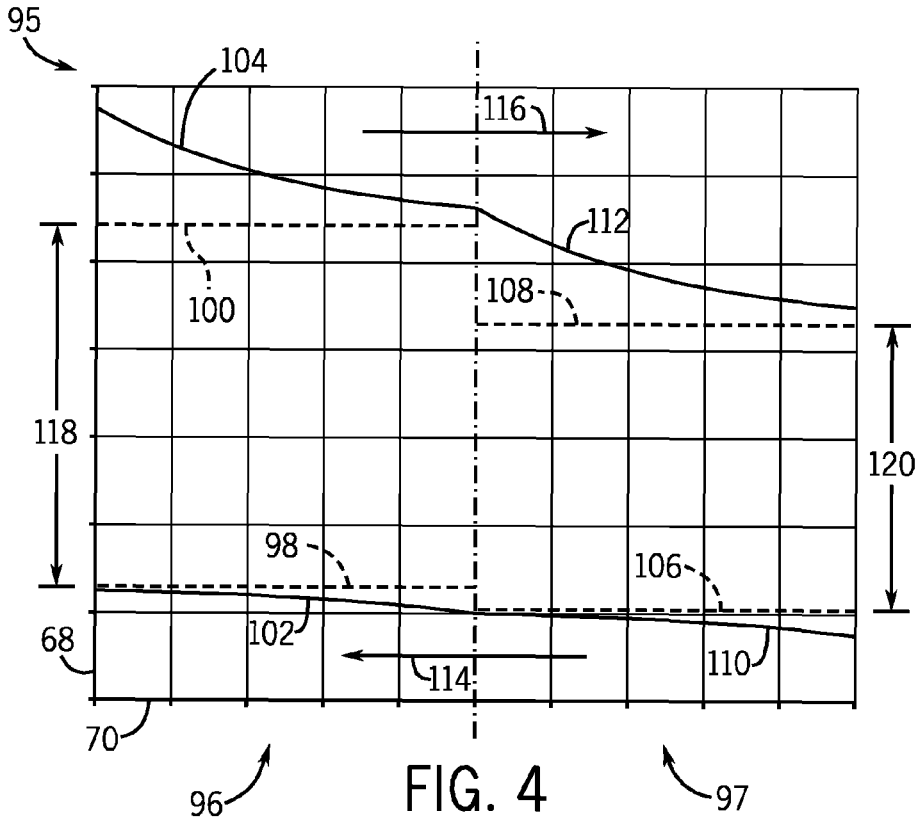
FIG. 4 is a chart depicting temperatures of the organic working fluid, the cooling fluid, and the heating fluid, as the fluids flow through the ORC units of FIG. 2.

FIGS. 3 and 4 depict the temperatures of the fluids flowing through heat recovery system 10 (FIG. 1), and heat recovery system 62 (FIG. 2), respectively. As discussed above, each heat recovery system 10 and 62 includes ORC units 12 and 14, which are disposed in series. The series arrangement of ORC units 12 and 14 may be designed to improve the efficiency of heat recovery systems 10 and 62. For example, it has now been shown that disposing ORC units 12 and 14 in a series arrangement allows the temperature difference within each ORC unit evaporator and condenser to be maximized, which in turn improves the Carnot efficiency, as well as the cycle efficiency of heat recovery systems. As may be appreciated, a Rankine cycle that uses an efficient turbine approximates the Carnot cycle. The efficiency of a Carnot cycle can be expressed as follows.

$$\eta = 1 - \frac{T_C}{T_H} \tag{1}$$

where $\eta$ is the Carnot efficiency; $T_H$ is the hot source temperature, represented by the saturation temperature within the ORC unit evaporator 28 or 30; and $T_C$ is the cold source temperature, represented by the saturation temperature within the ORC unit condenser 40 or 42. As shown by Equation 1, minimizing the ratio of $T_C$ to $T_H$ maximizes the Carnot efficiency ($\eta$). Accordingly, a greater temperature difference between $T_C$ and $T_H$ minimizes the ratio of $T_C$ to $T_H$, and in turn, increases the Carnot efficiency.

FIG. 3 is a chart 65 depicting the fluid temperatures within ORC units 12 and 14 when the ORC units 12 and 14 are disposed in a unidirectional series arrangement as shown in FIG. 1. Chart 65 includes a first section 66 that depicts the temperatures within ORC unit 12 and a second section 67 that depicts the temperatures within ORC unit 14. Y-axis 68 represents the temperature of the fluids, and x-axis 70 represents the progress of each fluid through ORC unit 12 or 14. Lines 72 and 74 depict the temperature of the organic working fluid as it flows through ORC unit 12. In particular, line 72 depicts the temperature of the organic working fluid as it flows through condenser 40, and line 74 depicts the temperature of the organic working fluid as it flows through evaporator 28. Line 76 represents the temperature of the cooling fluid circulating within circuit 43 as the cooling fluid flows through condenser 40, and line 78 represents the temperature of the heating fluid circulating within circuit 18 as the heating fluid flows through evaporator 28.

Within section 67, lines 80 and 82 depict the temperature of the organic working fluid as it flows through ORC unit 14. In particular, line 80 represents the temperature of the organic working fluid as it flows through condenser 42, and line 82 represents the temperature of the working fluid as it flows through evaporator 30. Line 84 represents the temperature of the cooling fluid circulating within circuit 43 as the cooling fluid flows through condenser 42, and line 86 represents the temperature of the heating fluid circulating within circuit 18 as the heating fluid flows through evaporator 30. Arrows 88 and 90 depict the direction of flow through ORC units 12 and 14. In particular, arrow 88 indicates the direction of flow of the cooling fluid through ORC units 12 and 14, while arrow 90 indicates the direction of flow of the heating fluid through ORC units 12 and 14.

As shown by arrows 88 and 90, ORC units 12 and 14 are disposed in a unidirectional series arrangement within heat recovery system 10 (FIG. 1). For example, as shown by arrow 88, the cooling fluid flows first through ORC unit 12 (represented by section 66) and then through ORC unit 14 (represented by section 67). Similarly, as shown by arrow 90 the heating fluid flows first through ORC unit 12 (represented by section 66) and then through ORC unit 14 (represented by section 67). As represented by line 78, the heating fluid first enters ORC unit 12 through evaporator 28 (FIG. 1). The heating fluid is at its highest temperature when the heating fluid enters ORC unit 12. The heating fluid decreases in temperature as the heating fluid flows through the evaporator and preheater and transfers heat to the working fluid. As shown by line 74, the temperature of the working fluid remains relatively constant at the saturation temperature ($T_H$), indicating that the working fluid is changing phases from a liquid to a vapor.

As shown by line 86, after exiting ORC unit 12 (section 66), the heating fluid enters ORC unit 14 through evaporator 30 (FIG. 1). The heating fluid enters evaporator 30 at a temperature that is approximately equal to the temperature of the heating fluid exiting ORC unit 12. The heating fluid decreases in temperature as the heating fluid flows through the evaporator and preheater of ORC unit 14 and transfers heat to the working fluid. As shown by line 82, the temperature of the working fluid remains relatively constant at the saturation temperature ($T_H$), indicating that the working fluid is changing phases from a liquid to a vapor.

As shown by line 76, the cooling fluid also enters the heat recovery system through ORC unit 12. The cooling fluid is at its lowest temperature when the cooling fluid enters ORC unit 12 through condenser 40 (FIG. 1). The cooling fluid increases in temperature as the cooling fluid flows through the condenser and absorbs heat from the working fluid. As shown by line 72, the temperature of the working fluid remains relatively constant at the saturation temperature ($T_C$), indicating that the working fluid is changing phases from a vapor to a liquid.

As shown by line 84, after exiting ORC unit 12 (section 66), the cooling fluid enters ORC unit 14 through condenser 42 (FIG. 1). The cooling fluid enters condenser 42 at a temperature that is approximately equal to the temperature of the cooling fluid exiting ORC unit 12. The cooling fluid increases in temperature as the cooling fluid flows through the condenser and absorbs heat from the working fluid. As shown by line 80, the temperature of the working fluid remains relatively constant at the saturation temperature ($T_C$), indicating that the working fluid is changing phases from a vapor to a liquid.

In summary, both the heating fluid and the cooling fluid first flow through ORC unit 12, as shown by section 66. Accordingly, ORC unit 12 receives the highest temperature heating fluid and the lowest temperature cooling fluid, and thereby experiences the greatest temperature difference 92 between the condenser and the evaporator. In particular, temperature difference 92 represents the difference between the temperature of the working fluid within condenser 40, as represented by line 72, and the temperature of the working fluid within evaporator 28, as represented by line 74. Due to the relatively large temperature difference 92, the Carnot efficiency is maximized within ORC unit 12.

Further, because ORC unit 12 receives the entire amount of cooling fluid and heating fluid, rather than receiving only half of the flow as seen in a parallel configuration, more heating and cooling may occur within the evaporators and condensers when compared to a heat recovery system employing a parallel configuration. Accordingly, the temperature difference 92 may be greater than the temperature difference experienced in a parallel configuration, which in turn may provide increased efficiency relative to a parallel configuration.

Moreover, for a given heat load, increasing the flow rate of the cooling and heating fluids through ORC units 12 and 14 allows the temperature difference across each heat exchanger (i.e., the temperature difference between the inlet cooling fluid and the outlet cooling fluid or the temperature difference between the inlet heating fluid and the outlet heating fluid) to be reduced. The reduced temperature difference across the heat exchanger allows the saturation temperature within the heat exchanger (i.e., as represented by lines 72, 74, 80, and 82) to be as close to the inlet temperature as possible. In other words, the saturation temperatures 74 and 82 within the evaporators 28 and 30 can be increased, while the saturation temperatures 72 and 80 within the condensers 40 and 42 can be decreased, relative to a parallel configuration. Accordingly, the saturation temperatures 72, 72, 80, and 82 within each unit 12 or 14 can be farther apart, allowing the temperature difference 92 or 94 to be greater. In summary, the series configuration provides an increased flow rate of the cooling fluid and the heating fluid through the ORC units 12 and 14, relative to a parallel configuration. The increased flow rate, in turn, allows the temperature difference 92 or 94 to be greater, which in turn may provide increased efficiency, relative to a parallel configuration.

Because the heating fluid and the cooling fluid have first passed through ORC unit 12 before entering ORC unit 14, the temperatures of the heating fluid and the cooling fluid will be closer together than in ORC unit 12. For example, the temperature of the heating fluid will be lower in ORC unit 14 than in ORC unit 12. Further, the temperature of the cooling fluid will be higher in ORC unit 14 than in ORC unit 12. Accordingly, the temperature difference 94 experienced in ORC unit 14 will be less than the temperature difference 92 experienced in ORC unit 12. In particular, temperature difference 94 represents the difference between the temperature of the working fluid within condenser 42, as represented by line 80, and the temperature of the working fluid within evaporator 30, as represented by line 82. However, even through the temperature difference 94 is less than the temperature difference 92 of ORC unit 12, the overall combined efficiency of ORC units 12 and 14 still may be greater than if the ORC units were arranged in a parallel configuration. According to certain embodiments, Carnot efficiency increases of approximately 30% and overall cycle efficiency increases of approximately 26% may be seen by employing a unidirectional series arrangement rather than a parallel flow arrangement.

As may be appreciated, the temperature differences 92 and 94 between the condenser and the evaporator also may govern the type and/or size of the turbines employed within ORC units 12 and 14. Accordingly, in certain embodiments, because the temperature differences 92 and 94 are relatively dissimilar, it may be beneficial to employ different types and/or sizes of turbines in ORC units 12 and 14. Further, different designs of heat exchangers may be employed in ORC units 12 and 14 due to the disparate temperature differences 92 and 94. Accordingly, each ORC unit 12 and 14 in a unidirectional series flow arrangement may have a different design configuration. However, a series counterflow arrangement as shown in FIG. 4, may allow the temperature differences to be closer to one another, which in turn may allow the same types of turbine and heat exchangers, as well as other equipment, to be used in the ORC units 12 and 14.

FIG. 4 is a chart 95 depicting the temperatures of the fluids within ORC units 12 and 14 when they are arranged in a series counterflow arrangement, as shown in FIG. 2. Chart 95 is divided into a first section 96 that represents ORC unit 12, and a second section 97 that represents ORC unit 14. Lines 98 and 100 depict the temperature of the organic working fluid as it flows through ORC unit 12. In particular, line 98 represents the temperature of the working fluid as it flows through condenser 40, and line 100 represents the temperature of the working fluid as it flows through evaporator 28. Line 102 represents the temperature of the cooling fluid circulating within the circuit 64 as the cooling fluid flows through condenser 40, and line 104 represents the temperature of the heating fluid circulating within circuit 18 as the heating fluid flows through evaporator 28.

Within section 97, lines 106 and 108 depict the temperature of the organic working fluid as it flows through ORC unit 14. In particular, line 106 represents the temperature of the organic working fluid as it flows through condenser 42, and line 108 represents the temperature of the working fluid as it flows through evaporator 30. Line 110 represents the temperature of the cooling fluid circulating within circuit 64 as the cooling fluid flows through condenser 42, and line 112 represents the temperature of the heating fluid circulating within circuit 18 as the heating fluid flows through evaporator 30. Arrows 114 and 116 depict the direction of flow through ORC units 12 and 14. In particular, arrow 114 indicates the direction of flow of the cooling fluid through ORC units 12 and 14, while arrow 116 indicates the direction of flow of the heating fluid through ORC units 12 and 14.

As shown by arrows 114 and 116, ORC units 12 and 14 are disposed in a series counterflow arrangement within heat recovery system 62 (FIG. 2). For example, as shown by arrow 114, the cooling fluid flows first through ORC unit 14 (represented by section 97) and then through ORC unit 12 (represented by section 96). As shown by arrow 116, the heating fluid flows through heat recovery system 62 in the opposite direction. For example, the heating fluid flows first through ORC unit 12 (represented by section 96) and then through ORC unit 14 (represented by section 97).

As represented by line 104, the heating fluid first enters ORC unit 12 through evaporator 28 (FIG. 2). The heating fluid is at its highest temperature when the heating fluid enters ORC unit 12. The heating fluid decreases in temperature as the heating fluid flows through the evaporator and preheater and transfers heat to the working fluid. As shown by line 100, the temperature of the working fluid remains relatively constant at the saturation temperature ($T_H$), indicating that the working fluid is changing phases from a liquid to a vapor.

As shown by line 112, after exiting ORC unit 12 (section 96), the heating fluid enters ORC unit 14 through evaporator 30 (FIG. 2). The heating fluid enters evaporator 30 at a temperature that is approximately equal to the temperature of the heating fluid exiting ORC unit 12. The heating fluid decreases in temperature as the heating fluid flows through the evaporator and preheater and transfers heat to the working fluid. As shown by line 108, the temperature of the working fluid remains relatively constant at the saturation temperature ($T_H$), indicating that the working fluid is changing phases from a liquid to a vapor.

As shown by line 110, the cooling fluid enters the heat recovery system in the opposite direction through ORC unit 14 (section 97). The cooling fluid is at its lowest temperature when the cooling fluid enters ORC unit 14 through condenser 42 (FIG. 2). The cooling fluid increases in temperature as the cooling fluid flows through the condenser and absorbs heat from the working fluid. As shown by line 106, the temperature of the working fluid remains relatively constant at the saturation temperature ($T_C$), indicating that the working fluid is changing phases from a vapor to a liquid.

As shown by line 102, after exiting ORC unit 14 (section 97), the cooling fluid enters ORC unit 12 (section 96) through condenser 40 (FIG. 2). The cooling fluid enters condenser 40 at a temperature that is approximately equal to the temperature of the cooling fluid exiting ORC unit 14. The cooling fluid increases in temperature as the cooling fluid flows through the condenser and absorbs heat from the working fluid. As shown by line 98, the temperature of the working fluid remains relatively constant at the saturation temperature ($T_C$), indicating that the working fluid is changing phases from a vapor to a liquid.

In summary, the heating fluid and the cooling fluid flow through the heat recovery system 62 in opposite directions, as indicated by arrows 114 and 116. Accordingly, ORC unit 12 (section 96) receives the highest temperature heating fluid, while ORC unit 14 (section 97) receives the lowest temperature cooling fluid. Further, the cooling fluid entering ORC unit 12 has already increased in temperature by flowing through ORC unit 14, while the heating fluid entering ORC unit 14 has already decreased in temperature by flowing through ORC unit 12. Accordingly, the temperature differences 118 and 120 experienced by the ORC units 12 and 14 in a series counterflow arrangement are closer to one another than the temperature differences 92 and 94 (FIG. 3) experienced by the ORC units 12 and 14 in a unidirectional series arrangement.

Although the temperature difference is not maximized in either of the ORC units 12 or 14, each ORC unit 12 and 14 experiences a moderate temperature difference. Accordingly, the cumulative temperature difference obtained by combining temperature differences 118 and 120 still may be greater than that typically seen in a parallel configuration. According to certain embodiments a Carnot efficiency improvement of approximately 30% and an overall cycle efficiency of approximately 26% may be seen when compared to a parallel configuration. Further, the similarity in the magnitude of the temperature differences 118 and 120 may allow the same design configuration may be used for each ORC system 12 and 14. For example, ORC systems 12 and 14 each may employ the same type and/or size of turbine 32 and 34, evaporator 28 and 30, condenser 40 and 42, and/or pump 44 and 46. The use of similar equipment between ORC system 12 and 14 may facilitate installation, operation, control, and/or maintenance of the heat recovery system 62, thereby reducing the cost and complexity of the overall heat recovery system.

Figure 5:
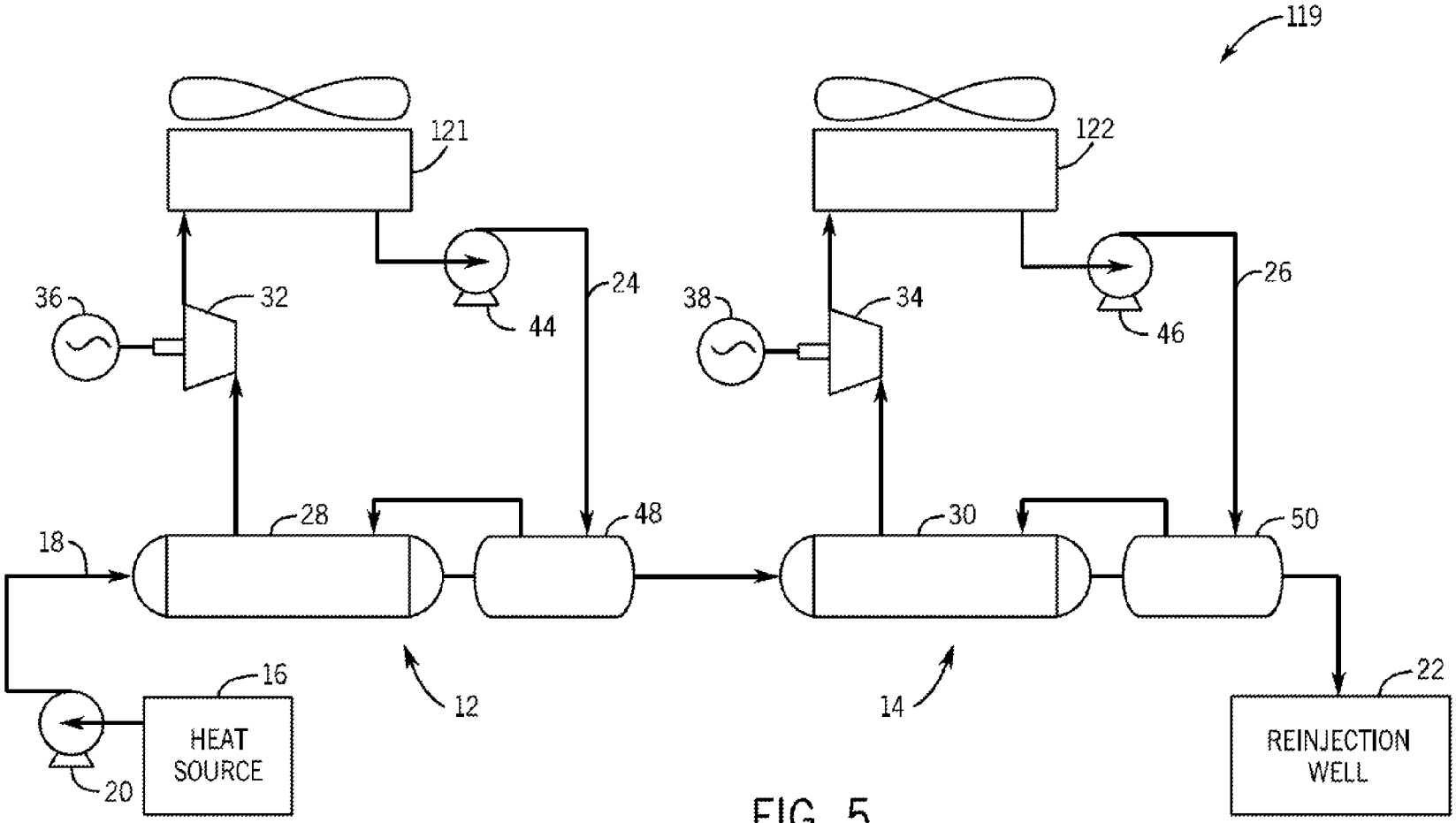
FIG. 5 is schematic flow diagram of another embodiment of a heat recovery system that employs multiple ORC units arranged in series.

FIG. 5 depicts another embodiment of a heat recovery system 119 that employs ORC units 12 and 14 in another series configuration. Heat recovery system 119 is generally similar to the heat recovery systems shown in FIGS. 1 and 2; however, rather than employing a cooling fluid circuit 64, heat recovery system 119 employs air-cooled condensers 121 and 122. Working fluid loops 24 and 26 circulate the expanded working fluid from turbines 32 and 34 to air-cooled condensers 121 and 122. As the working fluid flows through air-cooled condensers 121 and 122, the air-cooled condensers transfer heat from the working fluid to the environment. For example, air-cooled condensers 121 and 122 may include one or more fans that draw ambient air through air-cooled condenser 121 and 122 to absorb heat from the working fluid flowing through tubes of air-cooled condensers 121 and 122.

The cooled working fluid then flows through to pumps 44 and 46, which pressurize the working fluid and return the working fluid to preheaters 48 and 50, where the working fluid may continue the Rankine cycle, as generally described above with respect to FIGS. 1 and 2. In summary, heat recovery system 119 includes air-cooled condensers 121 and 122, instead of a cooling fluid circuit. Accordingly, the ORC units 12 and 14 are arranged in series only with respect to heating fluid circuit 18. For example, the heating fluid first flows through evaporator 28 and preheater 48 of ORC unit 12, and then flows through evaporator 30 and preheater 50 of ORC unit 14. The arrangement of ORC units 12 and 14 in series with respect to the heating fluid circuit may allow the temperature differences within the ORC units to be maximized, which again may provide increased Carnot efficiency and/or cycle efficiency.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A system comprising:

a first organic Rankine cycle unit comprising a first closed loop, a first organic working fluid, a first preheater, and a first evaporator, the first organic Rankine cycle unit configured to circulate the first organic working fluid within the first closed loop through a first turbine and a first pump;

a second organic Rankine cycle unit comprising a second closed loop, a second organic working fluid, a second preheater, and a second evaporator, the second organic Rankine cycle unit configured to circulate the second organic working fluid within the second closed loop through a second turbine and a second pump, wherein the first organic working fluid and the second organic working fluid have the same composition;

a heating fluid circuit comprising a heating fluid, wherein the heating fluid circuit is directly coupled to the first preheater of the first organic Rankine cycle unit, the first evaporator of the first organic Rankine cycle unit, the second preheater of the second organic Rankine cycle unit, and the second evaporator of the second organic Rankine cycle unit to vaporize the first organic working fluid and the second organic working fluid; and a cooling fluid circuit comprising a cooling fluid and configured to circulate the cooling fluid through the first organic Rankine cycle unit and the second organic Rankine cycle unit to cool the first organic working fluid and the second organic working fluid;

wherein the first organic Rankine cycle unit and the second organic Rankine cycle unit are disposed in series with respect to the heating fluid circuit and the cooling fluid circuit, wherein the heating fluid circuit and the cooling fluid circuit are configured to direct the heating fluid and the cooling fluid, respectively, through the first organic Rankine cycle unit and the second organic Rankine cycle unit in a series counter-flow arrangement, and wherein the heating fluid circuit is configured to direct the heating fluid in series through the first evaporator of the first organic Rankine cycle unit, the first preheater of the first organic Rankine cycle unit, the second evaporator of the second organic Rankine cycle unit, and the second preheater of the second organic Rankine cycle unit.

2. The system of claim 1, wherein the first turbine is coupled to a first generator and the second turbine is coupled to a second generator, wherein the first turbine coupled to the first generator and the second turbine coupled to the second generator are configured to produce electricity as the first organic working fluid is circulated through the first organic Rankine cycle unit and as the second organic working fluid is circulated through the second organic Rankine cycle unit.

3. The system of claim 1, wherein the first organic working fluid and the second organic working fluid each comprise a single-component refrigerant.

4. The system of claim 1, wherein the first organic working fluid and the second organic working fluid each comprise a hydrocarbon based refrigerant.

5. The system of claim 1, wherein the first organic working fluid and the second organic working fluid have no direct heat exchange with one another.

6. A system comprising:

a first organic Rankine cycle unit comprising a first organic working fluid, a first evaporator configured to vaporize the first organic working fluid to provide an at least partially vaporized first organic working fluid, a first turbine configured to expand the at least partially vaporized first organic working fluid to provide an expanded first organic working fluid, a first condenser configured to condense the expanded first organic working fluid to provide a condensed first organic working fluid, a first pump configured to pressurize the condensed first organic working fluid to provide a pressurized first organic working fluid, and a first preheater configured to preheat the pressurized first organic working fluid;

a second organic Rankine cycle unit comprising a second organic working fluid, a second evaporator configured to vaporize the second organic working fluid to provide an at least partially vaporized second organic working fluid, a second turbine configured to expand the at least partially vaporized second organic working fluid to provide an expanded second organic working fluid, a second condenser configured to condense the expanded second organic working fluid to provide a condensed second organic working fluid, a second pump configured to pressurize the condensed second organic working fluid to provide a pressurized second organic working fluid, and a second preheater configured to preheat the pressurized second organic working fluid, wherein the first organic working fluid and the second organic working fluid have the same composition;

a heating fluid circuit comprising a heating fluid, wherein the heating fluid circuit is directly coupled to the first evaporator, the first preheater, the second evaporator, and the second preheater in series to provide heat to the first evaporator, the first preheater, the second evaporator, and the second preheater; and a cooling fluid circuit comprising a cooling fluid, wherein the cooling fluid circuit is directly coupled to the first condenser and the second condenser in series to provide cooling to the first condenser and the second condenser; and wherein the heating fluid circuit comprises a heat source and is configured to direct the heating fluid from the heat source through the first evaporator, the first preheater, the second evaporator, and then through the second preheater, and wherein the cooling fluid circuit comprises a cooling source and is configured to direct the cooling fluid from the cooling source through the second condenser and then through the first condenser.

7. The system of claim 6, wherein the first organic Rankine cycle unit comprises a first generator coupled to the first turbine and the second organic Rankine cycle unit comprises a second generator coupled to the second turbine.

8. The system of claim 6, wherein the first organic Rankine cycle unit and the second organic Rankine cycle unit employ the same size of first and second evaporator, first and second turbine, first and second condenser, or first and second pump, or any combination thereof.

9. The system of claim 6, wherein the first organic working fluid and the second organic working fluid comprise HFC-245fa.

10. The system of claim 6, wherein the first organic working fluid and the second organic working fluid have no direct heat exchange with one another.

11. A system comprising:

a plurality of organic Rankine cycle units each comprising an organic working fluid, an evaporator configured to vaporize the organic working fluid to provide an at least partially vaporized organic working fluid, a turbine configured to expand the at least partially vaporized organic working fluid to provide an expanded organic working fluid, a condenser configured to condense the expanded organic working fluid to provide a condensed organic working fluid, a pump configured to pressurize the condensed organic working fluid, and a preheater configured to preheat the pressurized organic working fluid, wherein the organic working fluid of each of the plurality of organic Rankine cycle units have the same composition;

a heating fluid circuit comprising a heating fluid, wherein the heating fluid circuit is directly coupled to the evaporator and the preheater of each of the plurality of organic Rankine cycle units in series to provide heat to the evaporator and the preheater of each of the plurality of organic Rankine cycle units; and a cooling fluid circuit comprising a cooling fluid, wherein the cooling fluid circuit is directly coupled to the condenser of each of the plurality of organic Rankine cycle units in series to provide cooling to the condenser of each of the plurality of organic Rankine cycle units; and wherein the heating fluid circuit and the cooling fluid circuit are configured to direct the heating fluid and the cooling fluid, respectively, through the plurality of organic Rankine cycle units in a series counterflow arrangement.

12. The system of claim 11, wherein the organic working fluid of each of the plurality of organic Rankine cycle units has no direct heat exchange with one another.

* * * * *